United States Patent [19]

Haapala

[11] 3,982,366

[45] Sept. 28, 1976

[54] STRUCTURAL SPACE ELEMENT

[76] Inventor: Jalo P. Haapala, Temppelikatu 8 A 23, 00100 Helsinki 10, Finland

[22] Filed: Mar. 12, 1975

[21] Appl. No.: 557,553

[30] Foreign Application Priority Data

Nov. 27, 1974 Finland ..... 3425/74

[52] U.S. Cl. ..... 52/220; 138/117; 264/309; 52/236; 52/79

[51] Int. Cl.[2] ..... E04B 5/48; E04C 1/30

[58] Field of Search ..... 52/79, 234, 236, 228, 52/220, 438, 251, 593; 138/116, 117, 121, 122; 264/309

[56] References Cited

UNITED STATES PATENTS

| | | | |
|---|---|---|---|
| 1,058,674 | 4/1913 | Kertes | 52/593 |
| 3,086,629 | 4/1963 | Blitzer | 138/117 |
| 3,457,698 | 7/1969 | Albers | 52/220 |
| 3,468,081 | 9/1969 | Saarinen | 52/236 |
| 3,514,910 | 6/1970 | Comm | 52/228 |
| 3,550,334 | 12/1970 | Van Der Lely | 52/228 |
| 3,693,664 | 9/1972 | Schmunk | 138/121 |
| 3,750,366 | 8/1973 | Rich et al. | 52/79 |
| 3,751,864 | 8/1973 | Berger et al. | 52/79 |
| 3,778,528 | 12/1973 | Heifetz et al. | 52/79 |
| 3,793,428 | 2/1974 | Gordon | 264/309 |

FOREIGN PATENTS OR APPLICATIONS

| | | | |
|---|---|---|---|
| 1,518,637 | 2/1968 | France | 52/79 |

*Primary Examiner*—James L. Ridgill, Jr.
*Attorney, Agent, or Firm*—Frank J. Jordan

[57] ABSTRACT

Disclosed is a structural space element, which consists of a tube. The tube has on its outer surface joining collars transversal to the element, which extend around the tube. Every second of the joining collars has a larger circumference than the adjacent joining collars. The collars are joinable to smaller-circumference joining collars of other, respective space elements and vice versa so that spaces for conduits etc. are created between the elements. The collars of one element joined to the collars of the other elements form together a beam-pillar-ring system of the total structure, in which said elements are cogged crosswise to each other.

13 Claims, 31 Drawing Figures

STRUCTURAL SPACE ELEMENT

BACKGROUND OF THE INVENTION

The present invention relates to a structural element, e.g., a steel concrete space element, which consists of a tube having, on its outer surface, collars, transversal to the element, extending around the tube and fitted at regular intervals from each other. In building construction, tubular structural elements are known as space elements from, for example, Finnish Patent 42 001, according to which transversal ribs reinforce the elements. The ribs fit between the respective ribs of the adjacent element. The ribs do not, however, extend around the element which has a cross section of the shape of a ractangular parallellogram, a factor which limits the jointing possibilities. The element must alone bear all loads, and owing to its structure it is relatively heavy. Neither are the desired tube and channel spaces created between the jointed elements, and a continuous total structure, i.e., a beam-pillar-ring structure, is not created using this element. Besides, the elements cannot be cogged crosswise together.

It is also known to leave tube or channel spaces between the elements. Then it has, however, been necessary to fill at least some of the spaces created between vertical or horizontal walls, with supporting pillars or beams cast from concrete or with other such reinforcements as explained in, for example, U.S. Pat. No. 3 514 910 and German Patent Application DOS 2 166 304. A space element in which the collars completely encircle the tube and in which intermediate spaces are thus created between all surfaces of the elements has been introduced in, for example, German Patent Application DOS 2 200 052. Even according to this publication the joining collars of the space element are of equal circumference, and for this reason the collars, which serve as loadbearing parts of the total structure, cannot be dimensioned satisfactorily because, according to the building standards, the cross section of a loadbearing pillar must be of a predetermined size. For this reason the jointed walls of the space elements according to this publication, also, are in many cases unnecessarily thick. Neither does it give details as to how the elements are attached to each other in the event concrete reinforcements are not used.

SUMMARY OF THE INVENTION

The present invention provides a structural element in which no concrete or similar reinforcements are required between the elements, in which the size of the intermediate spaces between the elements can be selected according to the specific case and in which the elements are strongly bound to each other. The characteristics of the invention are given in the enclosed patent claims.

As to the advantages gained by the invention compared with the previously known elements, it can be said in addition to the above that the joining collars extending around the tube of the structural element, every second collar having a larger circumference than the adjacent ones, make it possible to use the allowed building space effectively by diminishing the space left between adjacent joining members. Thus, all technical installations, such as electrical, water, plumbing, ventilation, heating, cooling, etc., as well as sound and thermal insulation etc., can be placed within the minimum structural wall and floor thickness allowed by the building standards.

In addition, in jointing the elements, the joining collars with different circumferences make possible a continuous, sturdy structural entity — a beam-pillar-ring system — in which the elements cog crosswise to each other. The larger-circumference coupling collars of elements coming one on top of the other settle endwise, thereby forming a row of pillars extending all the way from the bottom to the top. Those parts of the wider collars which adjoin the floor and the ceiling serve as beams and those parts which adjoin the walls serve as pillars, thereby forming a continuous frame structure and stiffening the element in order to resist horizontal forces. When structural elements are stacked one on top of the other, the wider collars form the loadbearing part of the continuous total structure. The wider collars have also been designed so that together with the smaller-circumference joining collars they are capable of resisting the outer and inner loads directed at the element and caused by, for example, wind and forces from above. A structural element according to the invention also facilitates the installation in jointing the elements since the circumferences of the collars automatically fit in place, hanging the elements crosswise together. On the side walls of the element, the coupling collars can be wedge-shaped so that, especially under gravity, they are hooked to the respectively wedge-shaped collars of another element.

Furthermore, a structural element according to the invention is made considerably lighter than previously known elements and can be made several times longer than those, and still the element endures transportation, hoisting and installation. At least in low construction separate foundations are not necessary.

When a structural element is made for the purpose of being used as a space element of a building, it is preferably cast from steel concrete in one piece in one casting without extra finishing work, whereby smaller dimensions are achieved. Thereby the collars are bound to each other with steel concrete reinforcements placed especially in the longitudinal direction of the element. In general the floor of the space element and possibly also its ceiling are steel-reinforced structures. Likewise, the upper and/or lower parts of the side walls can also be reinforced. If necessary, reinforcement collars can be fitted between the joining collars of an element; they serve to reinforce the concrete films of the tube. If many elements are stacked one on top of the other and the horizontal forces grow considerably, the elements can be reinforced with structural outer and/or partition wall elements or plugs pressed or wedged into the ends of the element.

The structural element has mainly been described above as a space element of a building. The element can, however, be used for even other purposes than building construction. It can also be manufactured from other materials than concrete, in general from all solidifying and hardening materials and other materials that resist tension and compression. The multi-purpose structural elements according to the invention can also be used for temporary construction, and owing to their structure and lightness they can be used very well for construction in areas with problematic ground, such as earthquake areas.

BRIEF DESCRIPTION OF THE DRAWINGS

Three embodiments of the invention are described below with reference to the enclosed drawings, without, however limiting the invention to them.

More specifically, FIG. 1 shows a plan view of a structural element and the jointing of the element to two adjacent, respective elements. FIGS. 2 and 3 are cross sections of the element along lines 2—2 and 3—3 of FIG. 1. FIG. 4 is a side view of the element according to FIG. 1. FIG. 5 shows a partial cross section of a wall consisting of two elements whose reinforcement collars are not joined to each other, and FIG. 6 shows a partial cross section of a wall of two elements of which the collars are joined to each other. FIG. 7 is a cross section of part of the element, along line 7—7 of FIG. 6, and FIGS. 8 and 9 show longitudinal, horizontal sections of the wall parts of the elements along lines 8—8 and 9—9 of FIGS. 5 and 6.

DESCRIPTION OF THE PREFERRED EMBODIMENTS

Figure 1:
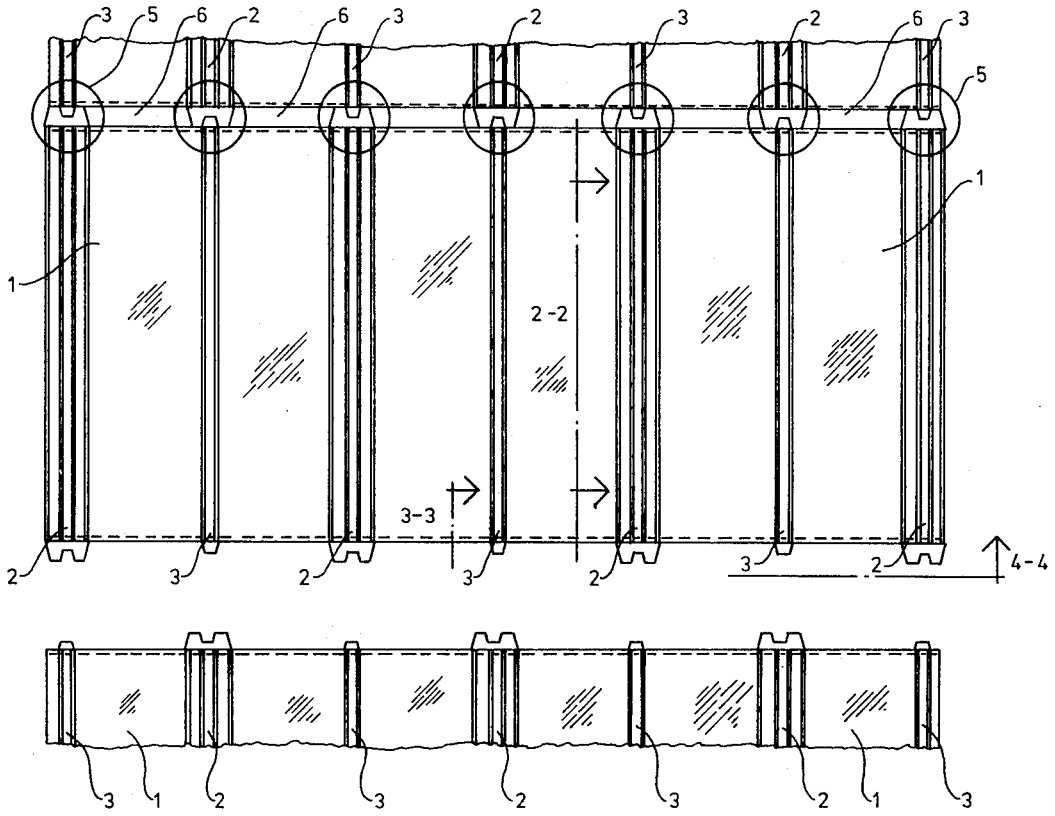
FIGS. 1–9 depict one embodiment of the invention,
FIGS. 10–18 respectively a second one, and
FIGS. 19–27 respectively a third one.
Figure 2:
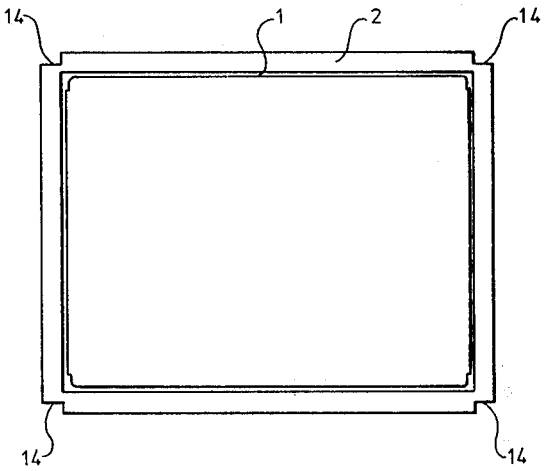
Figure 3:
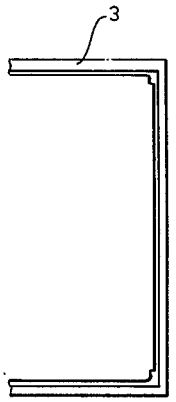
Figure 4:
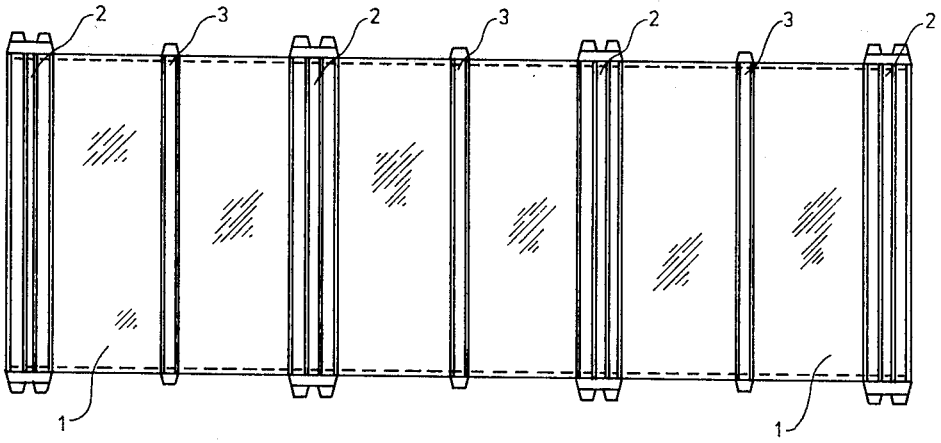
Figure 5:
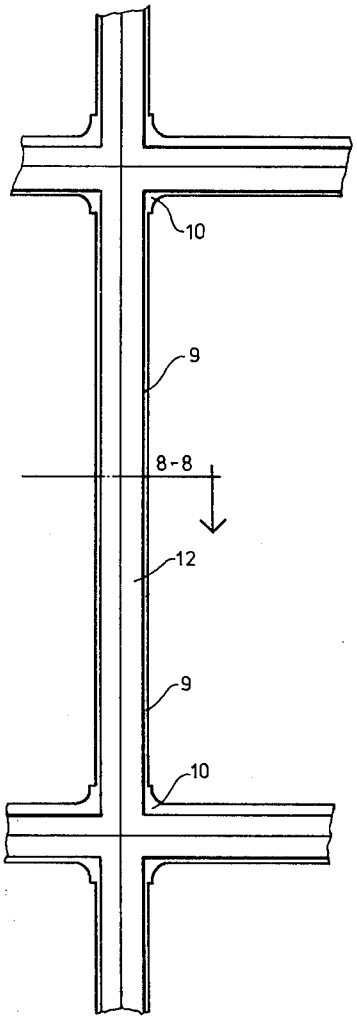
Figure 6:
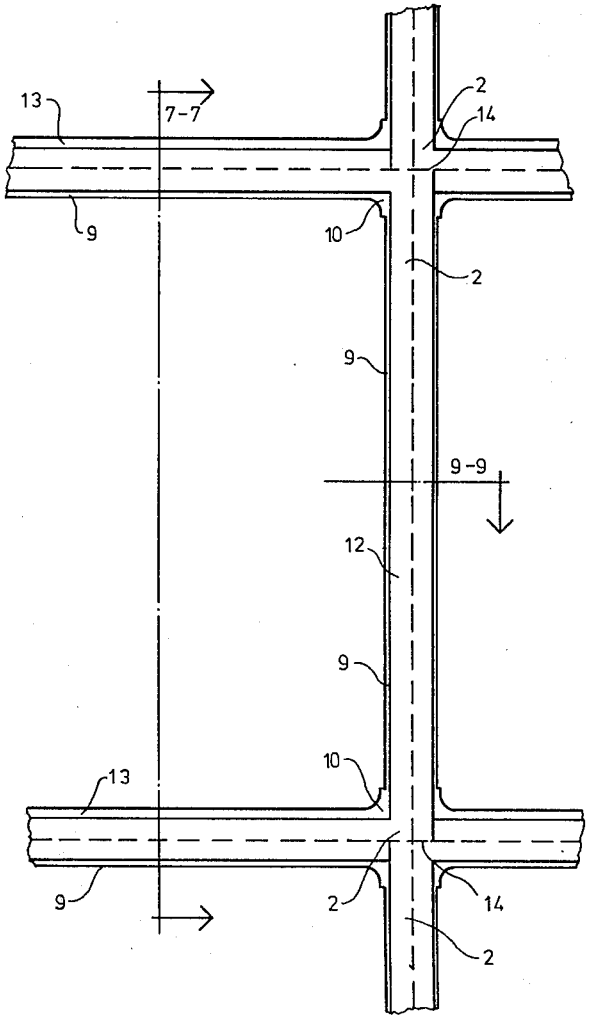
Figure 7:
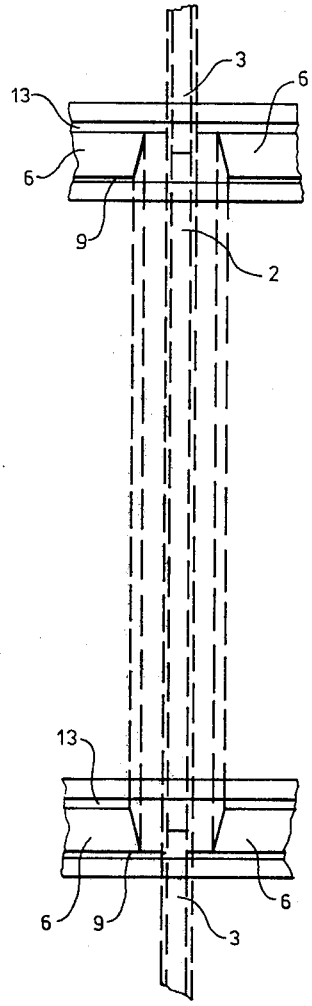
Figure 8:
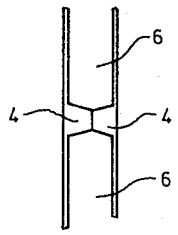
Figure 9:
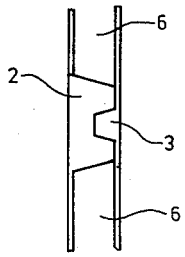
Figure 10:
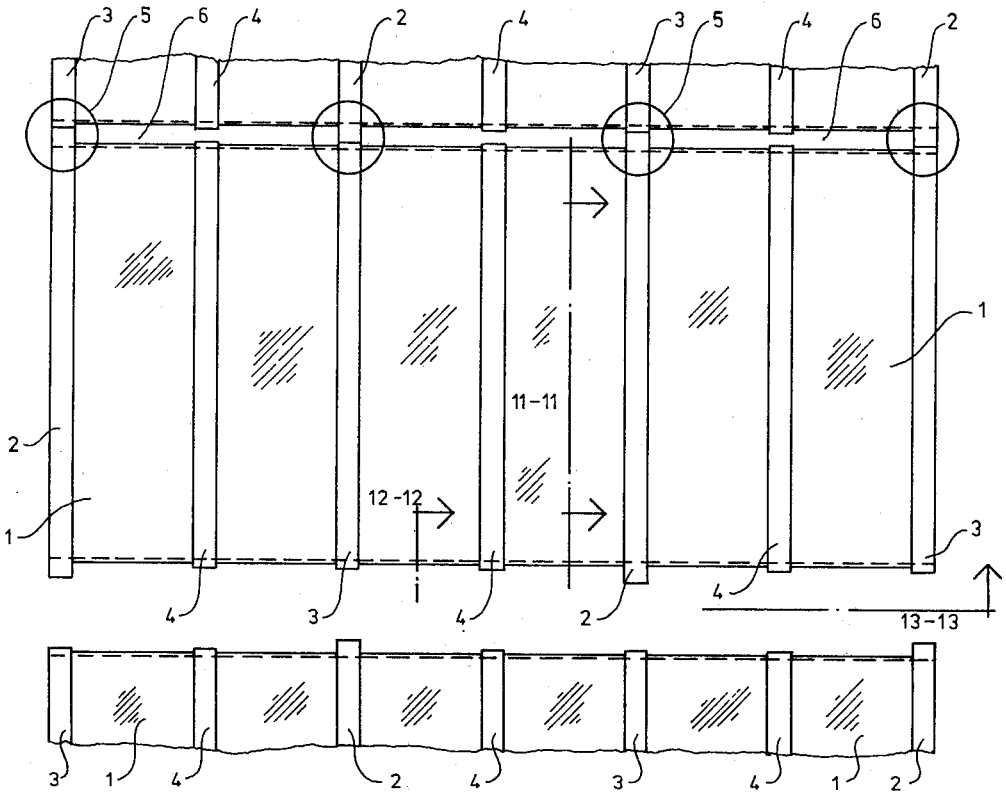
FIGS. 10–18 illustrate a second embodiment of the structural element in the same manner as FIGS. 1–9 respectively, and FIGS. 19–27 a third embodiment of the invention in the same manner as FIGS. 1–9 respectively.
Figure 11:
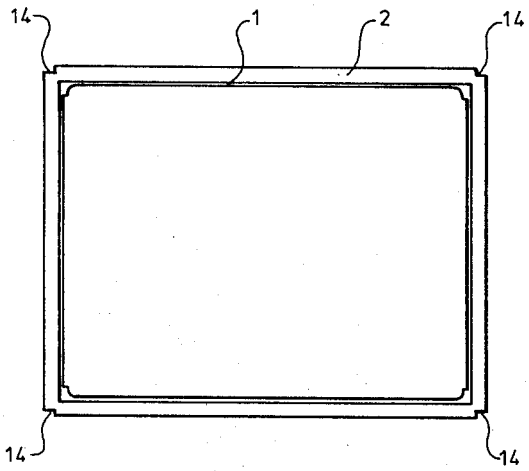
Figure 12:
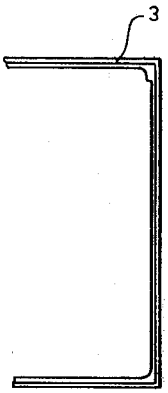
Figure 13:
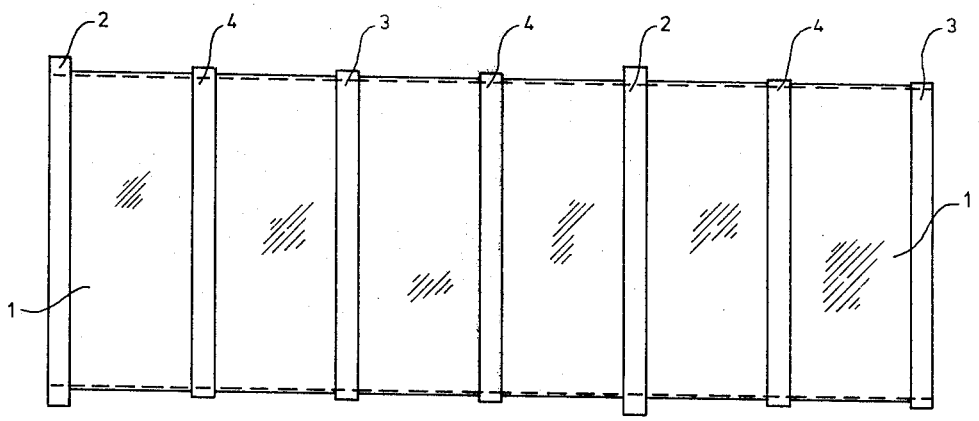
Figure 14:
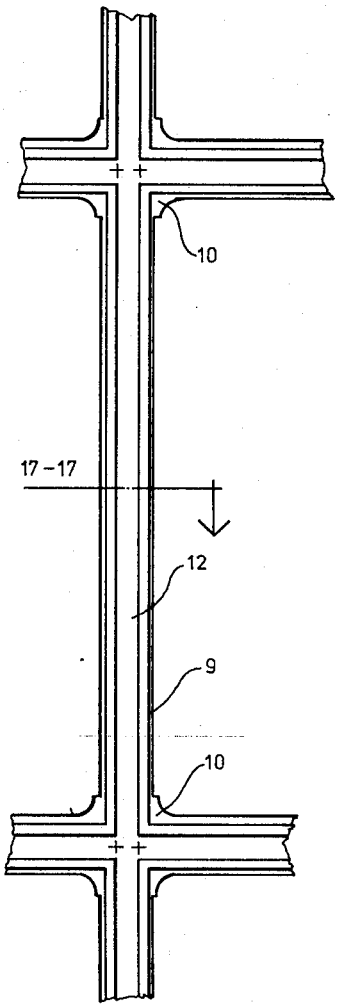
Figure 15:
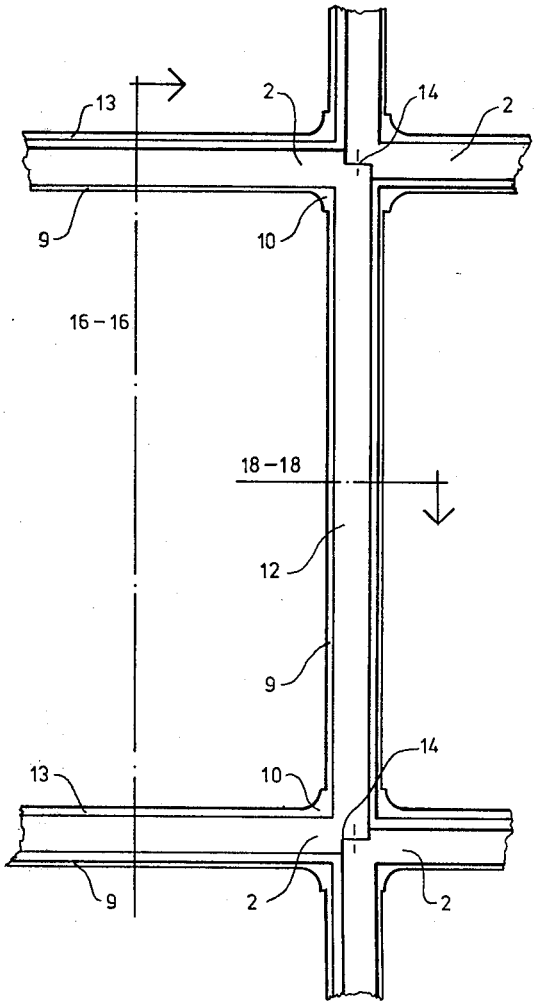
Figure 16:
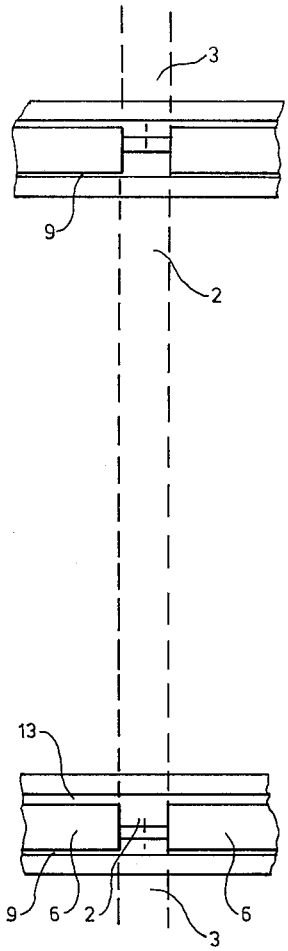
Figure 17:
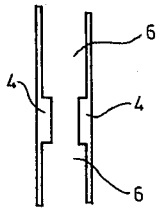
Figure 18:
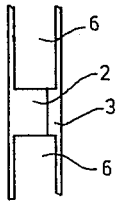
Figure 19:
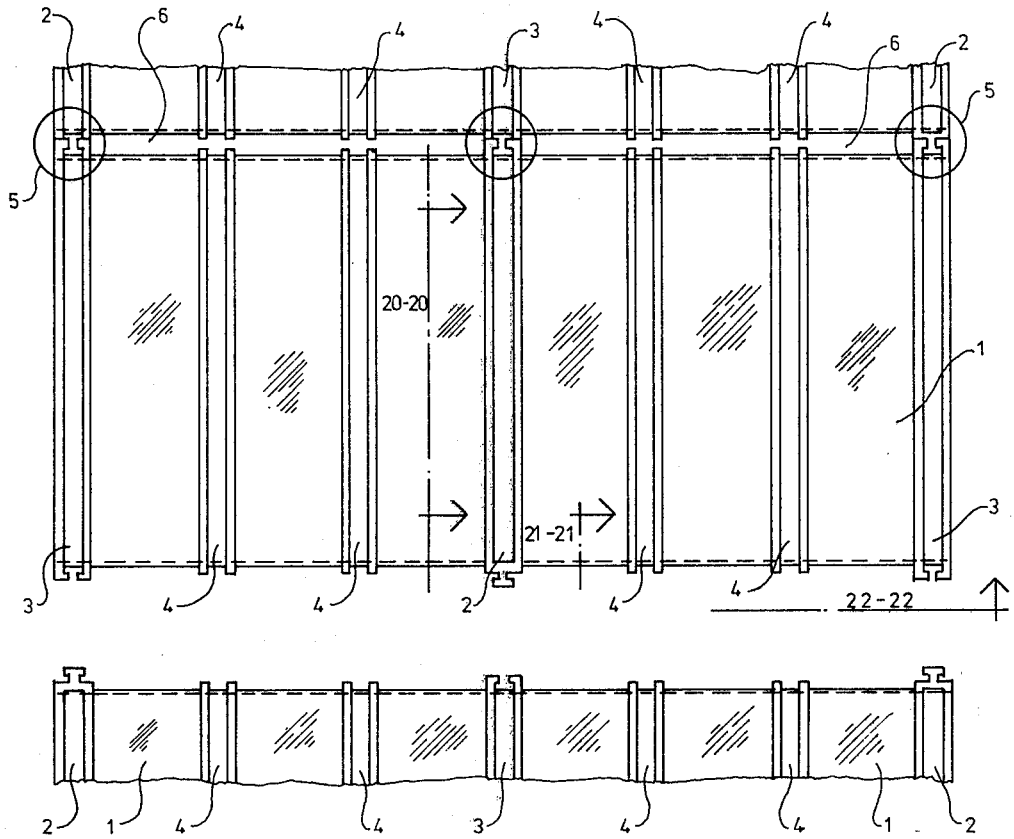
Figure 20:
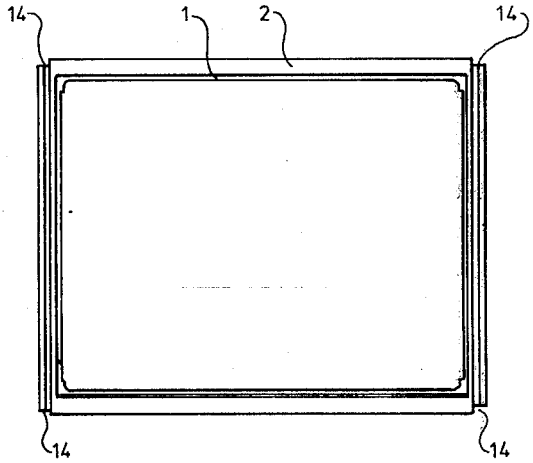
Figure 21:
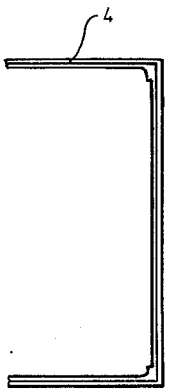
Figure 22:
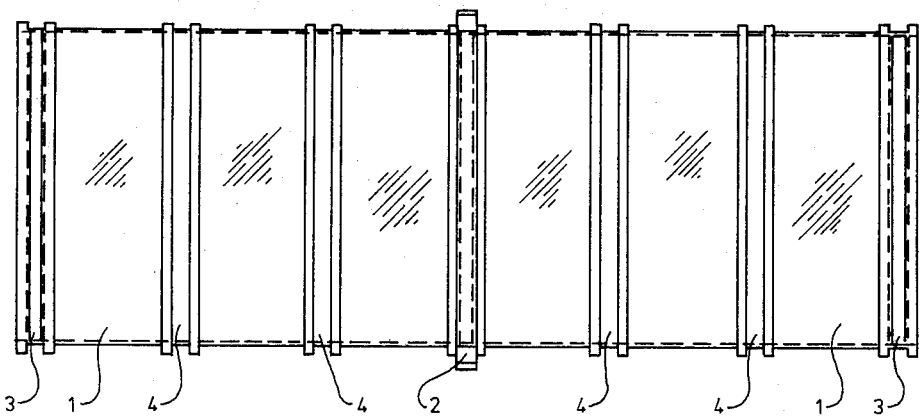
Figure 23:
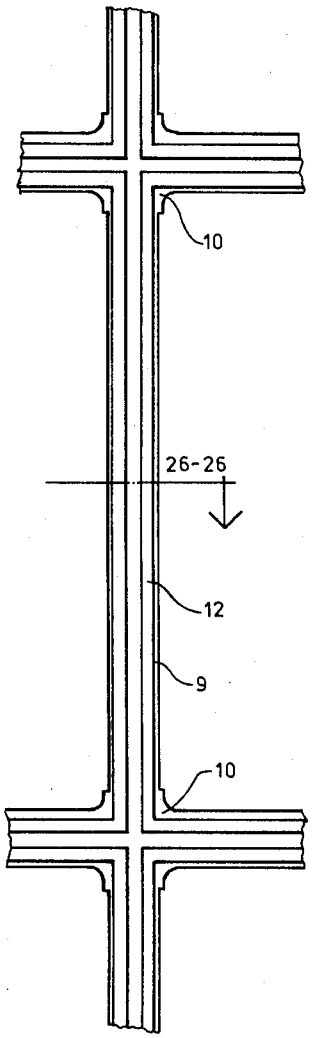
Figure 24:
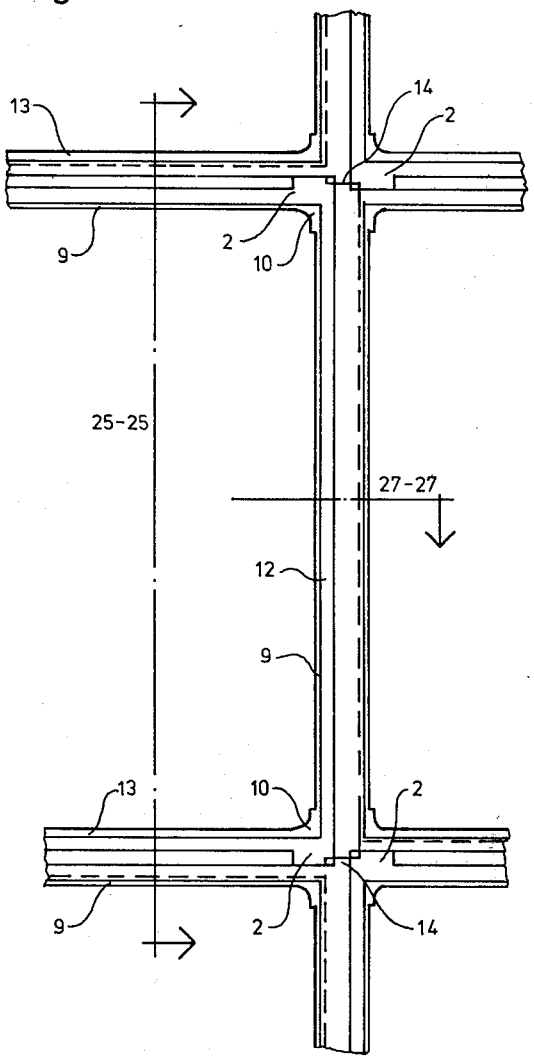
Figure 25:
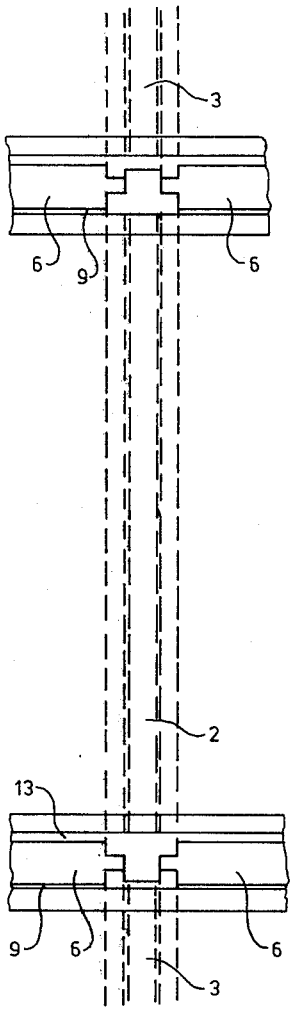
Figure 26:
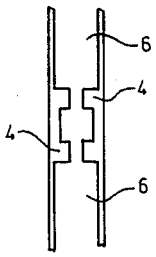
Figure 27:
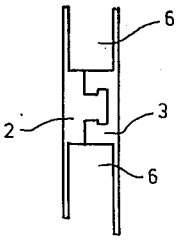

FIGS. 1–9 illustrate a structural element, especially a space element used in building construction, of which the tube 1 with a cross section the shape of a rectangular parallellogram has been cast in one piece with the collars. The walls of the tube are thin concrete film, the floor, on the other hand, is steel-reinforced. Every second collar, the male collar 3, has a cross section the shape of a cut isosceles triangle, and every second one, the female collar 2, has a cross section shape corresponding to the male one so that the male and female collars of elements to be jointed fit together. This is illustrated in FIG. 1, according to which the elements shown only partially are jointed to both sides of the central element, one of them being already jointed with the central element. In the embodiment according to FIGS. 1–9, the female collars 2, which have a wider circumference than the male collars, are the actual loadbearing parts. The jointing points where a vertical pillar 5 is formed are indicated by a circle. According to FIG. 1, there are pillars in each collar. Tube or channel spaces 6 are left between the elements for various installations and insulation, as mentioned above. FIGS. 5 and 8 show the adjacent walls of two elements; it is not necessary to joint the walls but the walls have only been reinforced by male collars which in this case serve as reinforcement collars 4 supporting the tube. The opposite walls, FIGS. 6 and 9, on the other hand, have been jointed together with collars 2 and 3. In FIGS. 5–7, the concrete films are indicated by 9. The angles between the floor and the walls of an element have been reinforced with steel concrete stiffeners 10 in the longitudinal direction of the element. In addition, the walls 12 have been reinforced with similar stiffeners over some distance downwards from the angle points formed between the ceiling and the walls; these stiffeners are not, however, indicated separately in the figure. The floor 13 is steel-reinforced. These measures together stiffen the element in the longitudinal direction of the tube. The larger-circumference joining collars, i.e., female collars 2, have shoulders 14 which have been fitted to bear on the shoulders 14 of the respective collars 2 of an element to be jointed to it.

FIGS. 10–18 illustrate an embodiment according to the invention in which the joining collars 2 with a wider circumference than the adjacent joining collars 3 have been fitted to be joined endwise to other, smaller-circumference joining collars of another element. The larger collars 2 are the actual loadbearing parts in the joint. The collars can be attached to each other in some manner known per se, e.g., by tenon jointing. In this embodiment the tubes 1 have been reinforced with reinforcement collars 4, which support them. A vertical pillar 5 is formed at every second collar. Other reference numbers indicate the same parts as in FIGS. 1–9.

FIGS. 19–27 illustrate an embodiment in which the joining parts of the male coupling collars 2 have a T-shaped cross section and the coupling parts of the female coupling collars 3 correspond to them. The collars 2 are actually the loadbearing parts in the joint. The tubes 1 have been reinforced with reinforcement collars 4, which support them and of which two have been fitted between each two joining collars. A vertical pillar 5 is formed at every third collar. The other reference numbers in these figures indicate the same parts as in the figures described above.

Figure 30:
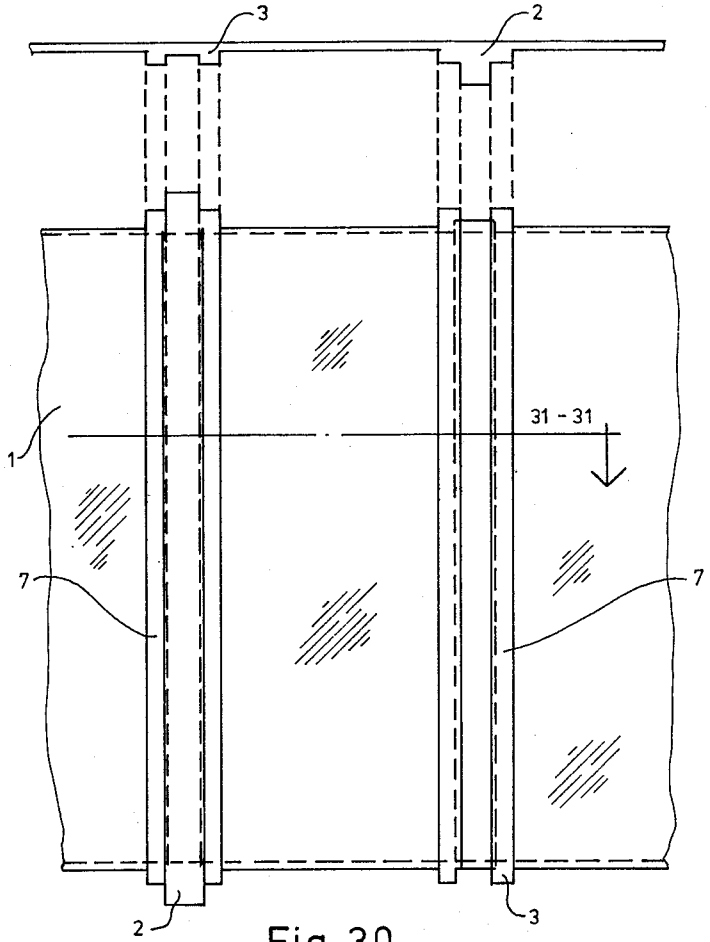
FIGS. 28–31 depict a special case in which the joining surfaces of the collars are wedge-shaped.
Figure 31:
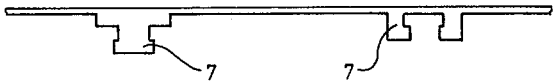
Figure 28:
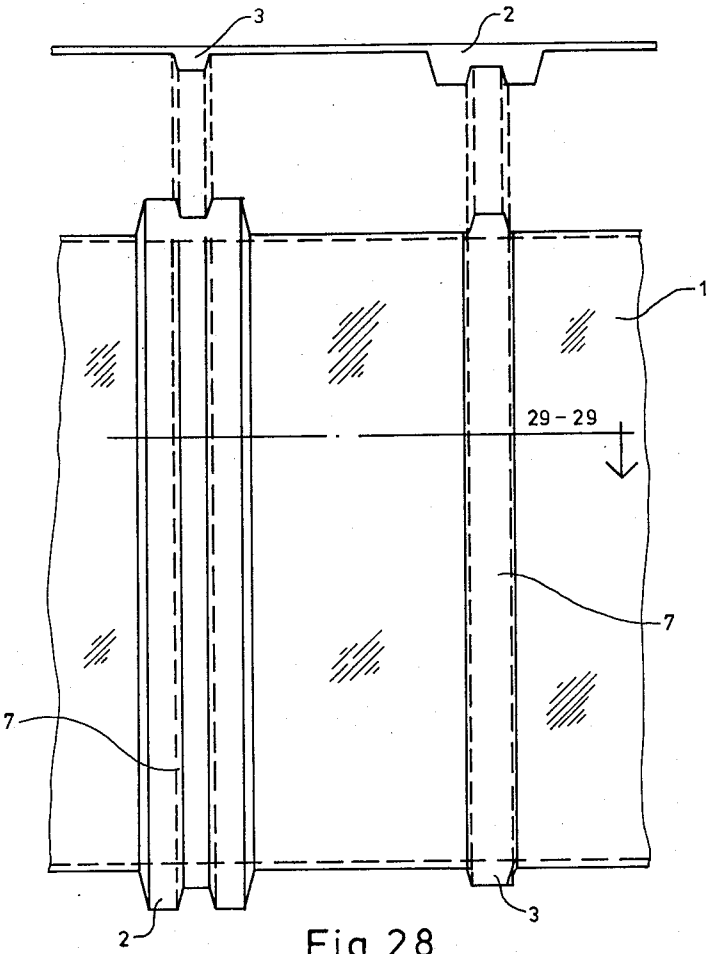
Figure 29:
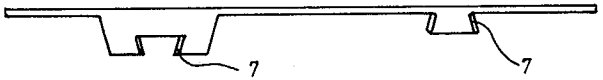

According to FIGS. 28–31, the joining collars of the side walls of an element are wedge-shaped in the manner that under gravity they hook into the respectively wedge-shaped joining collars of another element. The wedge surfaces of the collars are indicated by 7. The collars according to FIGS. 28 and 29 correspond to the collars according to FIGS. 1–9 and the collars according to FIGS. 30 and 31 correspond to the collars according to FIGS. 19–27. FIGS. 28 and 30 depict side views of the collars and FIGS. 29 and 31 the cross section shapes of the collars.

A structural element according to the invention can be varied within the following claims. The cross section shape of the tube can, for example, be arbitrary and the tube can be made from any desired material, either in one piece with the collars or from different parts, e.g., plates which are joined together. Although the invention makes it possible to make the tube from thin film, its thickness can naturally be varied according to its purpose. The shapes of the joining collars and the cross sections of their joining parts can also vary according to need. Likewise, the shapes and numbers of the reinforcement collars between the joining collars can vary.

What is claimed is:

1. A building structure comprising at least two space elements, each of said space elements comprising a tube element having two generally vertical walls along with a generally horizontal floor and ceiling, each of said tube elements having first collar means transversely circumscribing the outside of the respective tube element at spaced intervals, each of said tube elements having second collar means transversely circumscribing the outside of the respective tube elements at spaced intervals, said first circumscribing collar means being arranged in alternate spaced relationship with said second circumscribing collar means along the longitudinal length of each of said tube elements, said first circumscribing collar means on each tube element protruding further from each tube element than said second collar means on each respective tube element, said two space elements being mated with one another with said first circumscribing collar means disposed opposite said second circumscribing collar means such that the first circumscribing collar means on one space element mates with the second circumscribing collar means on the other space element and the second circumscribing collar means on said one space element mates with the first circumscribing collar means on the other space element, whereby said space elements are thereby spaced from one another as determined by said mating circumscribing collar means, said space between said two space elements being adapted to accommodate conduits, insulation, utilities and the like for said building structure, said mating circumscribing collar means of said two space elements forming a beam-pillar-ring having generally horizontal beams and generally vertical pillars for supporting said building structure.

2. A structural space element adapted to be arranged and mated with a similar structural space element to form a building structure comprising a tube element having two generally vertical walls along with a generally horizontal floor and ceiling, first circumscribing collar means transversely circumscribing the outside of said tube element at spaced intervals, second circumscribing collar means transversely circumscribing the outside of said tube element at spaced intervals, said first circumscribing collar means being arranged in alternate spaced relationship with said second circumscribing collar means along the longitudinal length of said tube element, said first circumscribing collar means protruding further from said tube element than said second circumscribing collar means, said structural space element being arranged and mated with said similar structural space element with said first circumscribing collar means being disposed opposite said second circumscribing collar means such that the first circumscribing collar means of the structural space element mate with the second circumscribing collar means of the similar structural space element and the second circumscribing collar means of the structural space element mate with the first circumscribing collar means of the similar structural space element, whereby said structural space elements are thereby spaced from another as determined by said mating first and second circumscribing collar means, said space between said structural space elements being adapted to accommodate conduits, insulation, utilities and the like for said building structure, said mating collar means of said structural space element and of said similar structural space element forming a beam-pillar-ring having generally horizontal beams and generally vertical pillars for supporting said building structure.

3. A structural space element according to claim 2 wherein said first and second collar means define shoulders which mate with one another.

4. A structural space element according to claim 2 wherein one of said first and second collar means has a generally T-shaped projection and the other of said first and second collar means comprises means defining a generally T-shaped groove in which said generally T-shaped projection is accommodated.

5. A structural space element according to claim 2 comprising reinforcing collars transversely circumscribing the outside of said tube element and spaced from said first and second collar means.

6. A structural space element according to claim 2 wherein said first collar means forms the load bearing support for the building structure.

7. A structural space element according to claim 2 wherein said second collar means forms the load bearing support for the building structure.

8. A structural space element according to claim 2 wherein said first and second collar means forms the load bearing support for the building structure.

9. A structural space element according to claim 2 which is cast in one piece from reinforced steel concrete in which said tube is of a relatively thin concrete film, and steel reinforced concrete stiffeners extending in the longitudinal direction of said element and securing said collar means to each other.

10. A structural space element according to claim 2 wherein one of said first and second collar means comprises means defining a groove and the other of said first and second collar means comprises a tongue which is accommodated in said groove.

11. A structural space element according to claim 10 wherein said first collar means includes said groove.

12. A structural space element according to claim 10 wherein said tongue and groove are tapered and generally in the form of a truncated isosceles triangle.

13. A structural space element according to claim 10 wherein said tongue and groove are in the form of a dovetail.

* * * * *